US005892353A

United States Patent [19]

Yama

[11] Patent Number: 5,892,353

[45] Date of Patent: Apr. 6, 1999

[54] POWER SUPPLY APPARATUS

[75] Inventor: Michiaki Yama, Kyoto, Japan

[73] Assignee: Rohm Co. Ltd., Kyoto, Japan

[21] Appl. No.: 895,370

[22] Filed: Jul. 16, 1997

[30] Foreign Application Priority Data

Jul. 25, 1996 [JP] Japan ..... 8-196749

[51] Int. Cl.[6] ..... G05F 1/40

[52] U.S. Cl. ..... 323/282; 323/222

[58] Field of Search ..... 323/222, 282; 363/21

[56] References Cited

U.S. PATENT DOCUMENTS 5,552,694 9/1996 Appeltans ..... 323/282
5,612,610 3/1997 Borghi et al. ..... 323/222
5,691,632 11/1997 Otake ..... 323/282
5,721,483 2/1998 Kolluri et al. ..... 323/222

FOREIGN PATENT DOCUMENTS 7087731 3/1995 Japan .

*Primary Examiner*—Stuart N. Hecker
*Attorney, Agent, or Firm*—Nikaido Marmelstein Murray & Oram LLP

[57] ABSTRACT

A power supply apparatus for stepping up an input voltage and for outputting a constant voltage includes an inductance element and a first transistor connected in series between an input terminal and an output terminal, a second transistor connected between a node between the inductance element and the first transistor and a reference potential, and a voltage holding element connected between the output terminal and the line of the reference potential. The first and second transistors are alternately rendered conductive in accordance with an output voltage from the output terminal while the voltage holding element is charged, so that the voltage of the power supply is stepped up.

9 Claims, 2 Drawing Sheets

POWER SUPPLY APPARATUS

BACKGROUND OF THE INVENTION

1. Field of the Invention

The present invention relates to a power supply apparatus and, more specifically, to a power supply apparatus such as a DC-DC converter often used as a power source for a portable apparatus or the like.

2. Description of the Background Art

Conventionally, a power supply circuit referred to as a step up/step down type DC-DC converter such as shown in FIG. 3 has been used for portable audio equipments such as a portable CD and a headphone stereo or for personal communication service. Alternatively, voltage of a dry cell or a secondary cell is transformed to be suitable for each equipment by using a power supply circuit employing a coil with a center tap, not shown, in order to reduce number of cells and to make the equipment light and compact. When a portable equipment such as mentioned above is used while moving, battery voltage of about 1.5V to about 3.5V is stepped up/down to about 3.0V to be used as the power supply voltage. When a battery of an automobile or a DC adapter is available, a voltage of about 3.5V to about 12V input through a connector is stepped down to about 3.0V to be used as the power supply voltage.

The structure of the power supply circuit shown in FIG. 3 will be described. There are a power supply V1 having a voltage value higher than an output voltage V3 at an output terminal OUT, and a power supply V2 having a voltage value lower than the output voltage V3. Power supply V1 is applied to a down converter 50 for stepping down the voltage, and the output voltage of down converter 50 and power supply V2 are switched by a switch circuit S1. The voltage switched by switch circuit Si is output to output terminal OUT through an inductance element 51, a diode 52 and an output circuit 59. Inductance element 51 generates a counter electromotive force for stepping up, and diode 52 prevents reverse flow and decrease of the step up voltage. Output circuit 59 controls supply of output voltage V3 to a load, not shown, connected to output terminal OUT. A capacitor element 56 is connected between a node between diode 52 and output circuit 59 and a reference potential (GND). Capacitor element 56 charges current of counter electromotive force (hereinafter referred to as charging current), and stabilizes output voltage V3.

A transistor 55 is connected between a node between inductance element 51 and diode 52 and the reference potential. Transistor 55 is driven by a driving circuit 54. Driving circuit 54 contains an oscillating circuit and periodically renders transistor 55 conductive or non-conductive (hereinafter referred to as switching operation). Output voltage V3' on the anode side of diode 52 is applied to an output voltage detecting circuit 53.

Output voltage detecting circuit 53 detects whether or not output voltage V3' is at a prescribed level, and in response to detection of malfunction or failure of output voltage V3', applies a detection signal to driving circuit 54 and an output failure detecting circuit 57. Driving circuit 54 controls period of the switching operation of transistor 55 in accordance with the detection output from output voltage detecting circuit 53. Output failure detecting circuit 57 compares a voltage generated by rectifying and smoothing a clock signal of driving circuit 54 with the charging voltage, and detects malfunction of the circuit. In response to detection of malfunction of the circuit, output failure detecting circuit 57 controls output driving circuit 58 and controls conduction of output transistor of output circuit 59.

FIGS. 4A to 4C show waveforms at various portions of the control apparatus shown in FIG. 3. FIG. 4A shows voltage waveform of the collector of transistor 55, FIG. 4B shows current waveform flowing through inductance element 51 and FIG. 4C shows enlarged voltage waveform near the output voltage of output terminal OUT. In each figure, t1 represents period of switching operation of transistor 55, VF represents forward voltage of diode 52, and Vsat represents saturation voltage of the transistor in output circuit 59. For simplicity, voltage ripples and the like are omitted in waveforms other than FIG. 4C.

The operation of the power supply shown in FIG. 3 will be described with reference to FIGS. 4A to 4C. Transistor 55 performs switching operation in response to a clock signal from the oscillating circuit in driving circuit 54. When transistor 55 is rendered conductive and the collector voltage is at the reference potential as shown in FIG. 4A, current flowing through inductance element 51 gradually increases as shown in FIG. 4B. When transistor 55 is non-conductive and the collector voltage is (V3'+VF), the charging current flowing through inductance element 51 gradually decreases, as the counter electromotive force of inductance element 51 lowers. Thereafter, while there is sufficient charging current, transistor 55 is again rendered conductive, increasing the charging current.

By the repetition of such switching operation, capacitor element 56 is gradually charged and its charging voltage V3' increases, and the voltage of the power supply selected by switch circuit S1 is stepped up. When the charging voltage attains to a prescribed value or higher, the transistor of output circuit 59 is rendered conductive, and a prescribed output voltage V3 (=V3'−Vsat) shown in FIG. 4C is supplied to the load.

Under normal operating condition, the output voltage of output failure detecting circuit 57 attains to a high level, transistor 55 performs switching operation in response to a clock signal from driving circuit 54 and thus stepping up operation is performed. The transistor of output circuit 59 is rendered conductive through output driving circuit 58, and the stepped up at voltage is output. Further, driving circuit 54 controls transistor 55 such that when the charging voltage V3' is lower than the prescribed voltage value, switching frequency is increased so as to increase the speed of charging and when the charging voltage V3' attains to the prescribed value, the switching frequency is lowered, whereby the output voltage V3 is kept constant.

In case of a malfunction where output terminal OUT is short-circuited to the reference potential, output failure detecting circuit 57 sets the output voltage thereof to a low level, controls output driving circuit 58 so as to render the transistor of output circuit 59 non-conductive, and stops switching operation of driving circuit 54. Consequently, flow of short-circuit current from respective power supplies to output terminal OUT can be prevented, and the circuits in the power supply apparatus can be protected.

Output failure detecting circuit 57 compares a voltage generated by rectifying and smoothing the clock signal of driving circuit 54 with the charging voltage V3', and though stepping up operation is performed in the above described state of malfunction, the charging voltage V3' is not boosted.

Meanwhile, when the power supply V1 having the voltage higher than the output voltage V3 is to be stepped down and output, power supply V1 is selected by switch circuit S1. The voltage of power supply V1 is stepped down by down converter 50, capacitor 56 is charged by means of inductance element 51 and diode element 52, and the charging voltage is output to output terminal OUT through output circuit 59. At this time, output of the clock signal of driving circuit 54 is stopped, transistor 55 is kept non-conductive and the transistor of output circuit 59 is kept conductive.

Meanwhile, in the power supply apparatus shown in FIG. 3, there is much loss because of diode 52. Even when a shot key diode having as small a forward voltage as about 0.4V is used as diode 52, it is difficult to have conversion efficiency of the power supply apparatus not lower than 85%, and therefore it is difficult to elongate the time of operation of the portable equipment or the like.

Further, in order to reduce power consumption while the portable equipment is in a sleep state, it is necessary to provide output driving circuit 58 and output circuit 59 so as to prevent supply of voltage from output terminal OUT to the load. Further, since output failure detecting circuit 57 is used for protecting the power supply circuit from malfunction such as short-circuit of output terminal OUT to the reference potential, the circuit scale is considerably large and number of components used is large, resulting in increased area of the circuit board. From the foregoing, purchase and maintenance of components require much labor and cost, and outer size of the power supply apparatus is considerably large. Therefore, the outer size of the portable equipment using the power supply cannot be reduced, resulting in poor portability and high cost.

Meanwhile, the power supply apparatus using a coil with a center tap, not shown, is expensive and reduction in size of the equipment is difficult, since the coil is special and not versatile, and in addition, it is expensive.

SUMMARY OF THE INVENTION

Therefore, an object of the present invention is to provide a portable equipment which is convenient for use and has long operation time, by forming a power supply circuit for the portable equipment with small power loss in simple circuit structure so as to facilitate incorporation of the power supply in the portable equipment.

Briefly stated, the present invention provides a power supply apparatus for stepping up a voltage input from a power supply for outputting a constant voltage from an output terminal, including an inductance element and a first switching element connected in series between an input terminal and the output terminal, a second switching element connected between a node between the inductance element and the first switching element and a line of a reference potential, a voltage holding element connected between the output terminal and the line of the reference potential, and a control circuit for charging the voltage holding element and for stepping up the voltage of the power supply while alternately rendering conductive the first and second switching elements in accordance with the output voltage from the output terminal.

Therefore, according to the present invention, by performing complementary switching operation in which two switching elements are alternately rendered conductive, stepping up of the power supply voltage can be realized by a simple circuit structure without the necessity of a diode for preventing reverse flow. Therefore, power loss by the diode for preventing the reverse flow is eliminated, and efficiency in conversion of the voltage change can be improved easily. Further, a portable equipment convenient for use and having long operation time can be readily provided, the circuit scale of the power supply apparatus can be made smaller and the unit price of the power supply apparatus can be readily decreased. Further, since the power supply circuit is made compact, it can be easily incorporated in a portable equipment, and therefore, the equipment using the power supply apparatus can be readily made compact at a low cost.

In a preferred embodiment, the control circuit includes an input voltage detecting circuit and a power supply control circuit. The input voltage detecting circuit detects whether or not the voltage of the power supply attains to a prescribed voltage or higher. The power supply control circuit outputs a constant voltage which is stepped up by alternate conduction of the first and second switching elements, in response to detection of the voltage of the power supply being lower than the prescribed voltage, and outputs a voltage which is stepped down from the power supply voltage by controlling an input voltage to the first switching element, in response to detection of the power supply voltage being higher than the prescribed voltage.

Therefore, in this preferred embodiment, the power supply voltage can be stepped up or down by a simple circuit structure, and hence a convenient power supply apparatus for a portable equipment can be realized.

In an preferred embodiment, power supply control circuit includes a constant voltage circuit for comparing a voltage at the output terminal with a predetermined voltage for controlling the input voltage of the first switching element, a light load detecting circuit for comparing the voltage at the output terminal and a voltage at a node between the inductance element and the first switching element for rendering non-conductive the first switching element when the voltage at the output terminal is higher than the voltage at the node, a switch circuit for switching the output signal from the constant voltage circuit and the output signal from the light load detecting circuit to be applied to the first switching element, and an input voltage detecting circuit responsive to the power supply voltage being not lower than a prescribed voltage, for switching the switch circuit to the side of the constant voltage circuit and responsive to the power supply voltage being not higher than the prescribed voltage, for switching the switch circuit to the side of the light load detecting circuit.

In a more preferred embodiment, the light load detecting circuit includes a comparing circuit comparing the voltage at the output terminal and the voltage at the node between the inductance element and the first switching element, and an OR gate providing an OR of the comparison output and the input voltage of the second switching element to be applied to the switch circuit.

In a more preferred embodiment, the power supply control circuit renders conductive the second switching element at a prescribed duty ratio, when the voltage at the output terminal is not higher than a predetermined voltage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
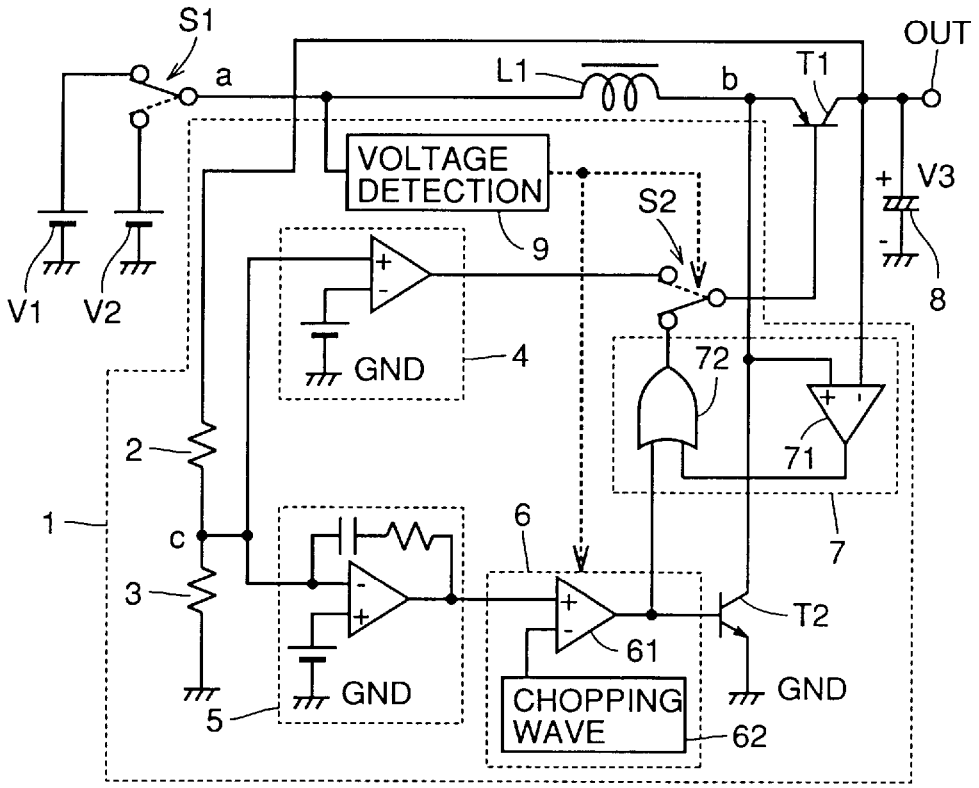
FIG. 1 is a circuit diagram of one embodiment of the present invention.

FIG. 1 is a circuit diagram of one embodiment of the present invention. Referring to FIG. 1, power supply V1 having a voltage value higher than the output voltage V3 output from output terminal OUT and power supply V2 having a voltage value lower than the output voltage V3 are applied to switch circuit Si. An output voltage from a DC adapter or the like is used as power supply V1, and a dry cell or a secondary cell is used as the power supply V2. Switch circuit S1 selects either power supply V1 or V2, and the selected power supply is applied to one end of inductance element L1 which generates a counter electromotive force for stepping up. The other end of inductance element L1 is connected to the emitter of a PNP transistor T1. The collector of the transistor is connected to output terminal OUT. Transistor T1 controls whether the current caused by the counter electromotive force is to be output to the side of output terminal OUT or not.

A voltage holding element 8 is connected between output terminal OUT and a reference potential. Voltage holding element 8 charges current caused by the counter electromotive force flowing through transistor T1 so as to maintain output voltage, and reduces output impedance. An electrolytic capacitor is used as voltage holding element 8. The aforementioned the other end of inductance element L1 is further connected to the collector of an NPN transistor T2. The emitter of transistor T2 is connected to a reference potential. Transistor T2 is for connecting one end on the side of transistor T1 of inductance element L1 to the reference potential. As inductance element L1, a so-called choke coil formed by winding a coil on a core of ferrite or amorphous metal is used.

Further, in order to control operations of the transistors, a control circuit portion 1 is provided. Control circuit portion 1 includes resistors 2 and 3 connected in series between output terminal OUT and the reference potential for generating a prescribed divided voltage, a constant voltage circuit 4, an error detecting circuit 5, a driving circuit 6, a light load detecting circuit 7, a voltage detecting circuit 9 and a switch circuit S2.

Error detecting circuit 5 includes a comparing circuit and a reference voltage source of about 1.2V provided by a band gap voltage, for example, connected to a non-inversion input (+) thereof. A divided voltage of point c is input to an inversion input (−), and its output is fed back through a resistor and a capacitor. When the voltage at point c is not higher than the voltage of the reference voltage source, a high level signal is applied to driving circuit 6. Driving circuit 6 includes a comparing circuit 61 and a chopping wave generating circuit 62. An output signal from error detecting circuit 5 is applied to non-inversion input of comparing circuit 61, and a chopping wave signal from chopping wave generating circuit 62 is applied to the inversion input. In response to the result of comparison between the detection signal from error detecting circuit 5 and the chopping wave signal, comparing circuit 61 performs switching operations such that the transistor T2 is rendered conductive at an arbitrary duty between 0 to 80% of the period t1.

Constant voltage circuit 4 includes a comparing circuit and a reference voltage source of about 1.2V provided by a band gap voltage connected to its inversion input. A divided voltage at point c provided by resistors 2 and 3 described above is applied to a non-inversion input. The comparing circuit compares the divided voltage and the reference voltage, and controls the base voltage of transistor T1 such that a constant voltage in accordance with the voltage at the reference voltage source is output to output terminal OUT, and steps down the input voltage to the constant output voltage.

Input voltage detecting circuit 9 is adapted to control switch circuit S2 such that stepping up or stepping down operation is switched in accordance with the input voltage so that the input applied to the base of transistor Ti is switched. More specifically, when the input voltage is higher than a prescribed voltage, the output of constant voltage circuit is applied to the base of transistor T2 through switch circuit S2 so as to perform step down operation, when the input voltage is lower than the prescribed voltage, the output signal from driving circuit 6 is connected to the base of transistor T1 through light load detecting circuit 7 so as to perform stepping up operation, and when the current flowing through inductance element L1 is interrupted, the voltage of power supply V2 is applied to the base of transistor T1, so that transistor T1 is rendered non-conductive.

Light load detecting circuit 7 includes a comparing circuit 71 and an OR gate 72. An inversion input of comparing circuit 71 is connected to output terminal OUT, and the non-inversion input is provided with the voltage at point b which is the other end of the inductance element L1. When the output voltage V3 is higher than the voltage at point b at the time of step up operation, transistor T1 is rendered non-conductive.

Constant values in this embodiment may be appropriately set in accordance with the current value necessary for the load connected thereto. For example, when the frequency of switching is set to several to 10 $\mu$sec, inductance value of inductance element L1 is set to several $\mu$H to several mH, capacitance value of voltage holding element 8 is set to about several 100 $\mu$F, a current of about tens to several 100 mA may be supplied to the load.

Figure 2A:
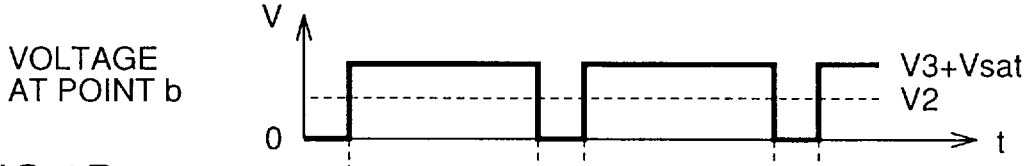
FIGS. 2A to 2C are timing charts showing waveforms of operation of main portions of the embodiment of the present invention.
Figure 2B:
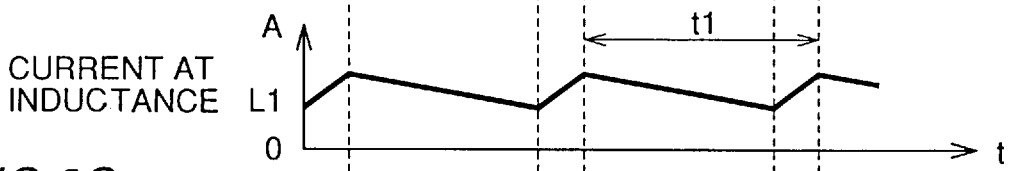
Figure 2C:
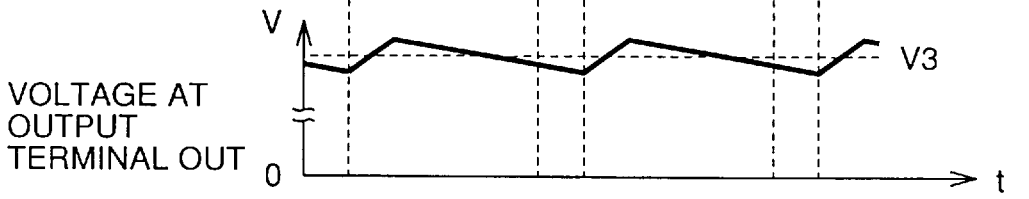
Figure 3:
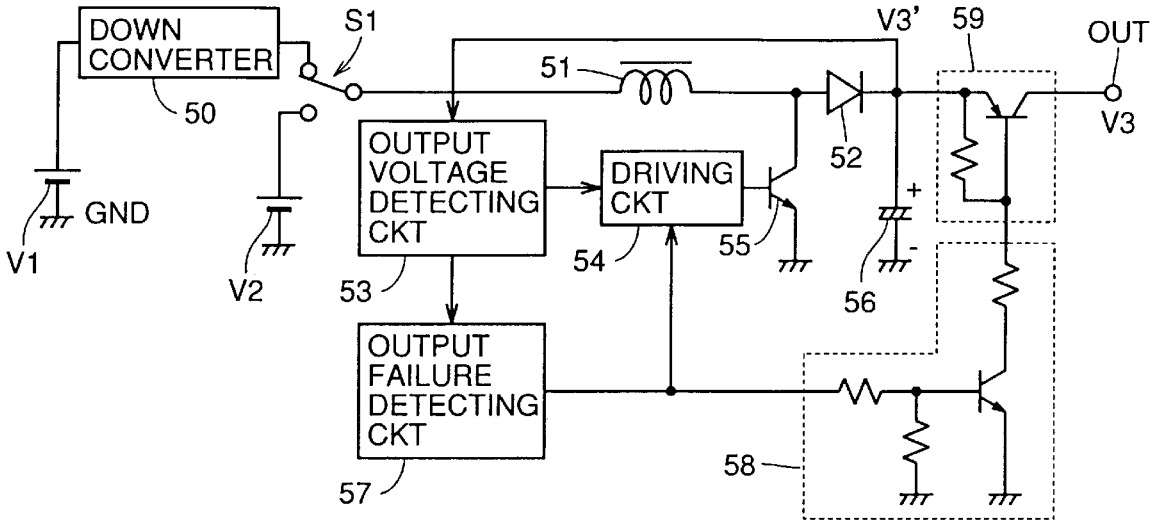
FIG.3 PRIOR ART
FIG. 3 is a circuit diagram showing an example of a conventional power supply apparatus.
Figure 4A:
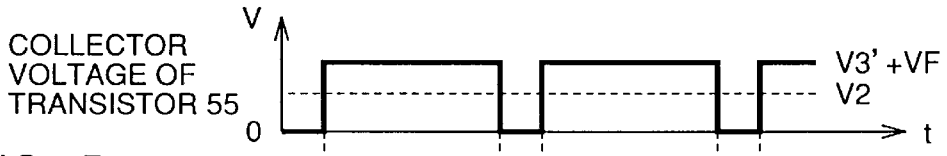
FIG.4A PRIOR ART
FIGS. 4A to 4C are timing charts showing waveforms of operations of main portions of the conventional power supply apparatus.
Figure 4B:
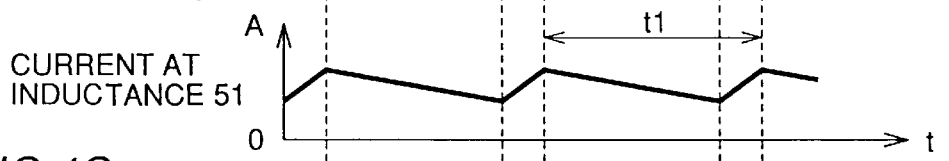
FIG.4B PRIOR ART
Figure 4C:
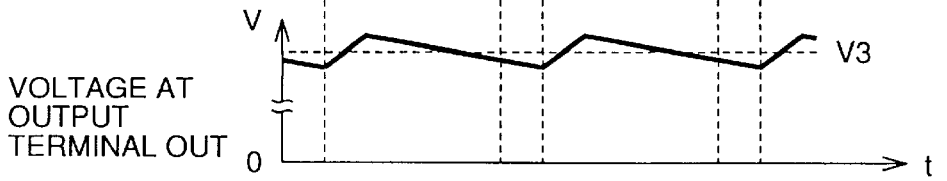
FIG.4C PRIOR ART

FIGS. 2A to 2C are timing charts showing waveforms of operation of main portions when power supply V2 is selected, sufficient stepping up operation is performed and the output voltage is stable, in the circuit of FIG. 1. FIG. 2A shows the waveform of voltage at the emitter (point b) of transistor T1, FIG. 2B shows waveform of current flowing through inductance element L1, and FIG. 2C shows enlarged voltage waveform near the output voltage of output terminal OUT. In these figures, t1 represents period of switching operation of transistor T1, and Vsat represent saturation voltage of transistor T1. For simplicity, ripples of the voltage and the like are not shown in the timing charts other than FIG. 2C.

When stepping up operation is to be performed, the output side is connected to the base of transistor T1 by input voltage detecting circuit 9 and switch S2, and a timing signal is input to the bases of transistors T1 and T2 from driving circuit 6. Since transistors T1 and T2 are of PNP type and NPN type, respectively, when the same signal is applied, one is rendered conductive and the other is rendered non-conductive (hereinafter referred to as complementary switching operation). More specifically, since transistors are rendered conductive or non-conductive alternately, in the period in which the voltage at point b is at the reference potential in FIG. 2A, that is, the period in which transistor T2 is rendered conductive and transistor T1 is rendered non-conductive, the current flowing through inductance element L1 and transistor T2 to the reference potential gradually increases as shown in FIG. 2B.

In the period in which the voltage at point b is (V3+VsaT), transistor T2 is rendered non-conductive and transistor T1 is rendered conductive, the charging current flowing through inductance element L1 is caused to flow through transistor T1 to voltage holding element 8 for charging, and the charge voltage is provided as output voltage V3 as shown in FIG. 2C. Since the counter electromotive force of inductance element L1 gradually lowers, the charging current also gradually lowers, and therefore while there is sufficient charging current, transistor T2 is again rendered conductive, increasing the charging current.

By the repetition of such complementary switching operation, voltage holding element 8 is gradually charged, the voltage of power supply V2 selected by switch circuit S1 is increased to a prescribed constant voltage and the charge voltage is supplied to the load as output voltage V3. In this circuit, the voltage can be boosted to about twice the power supply V2.

The overall circuit operation will be described in the following. In the normal state of operation for stepping up the power supply V2, the output of light load detecting circuit 7 is applied to the base of transistor T1 by input voltage detecting circuit 9 and switch circuit S2, respective transistors perform complementary switching operation and stepping up is performed. However, after the start of switching operation, voltage holding element 8 is not yet sufficiently charged for a while, and therefore the output voltage V3 and the voltage at point c are low and the output of error detection circuit 5 attains to the high level. Accordingly, as a result of comparison between the chopping wave signal and the output signal of error detecting circuit 5 by comparing circuit 61 of driving circuit 6, conduction period of transistor T2 is made longer, enabling charging operation with large charging current. Thereafter, when the output voltage V3 gradually increases and the voltage at point c attains higher, the output of error detecting circuit 5 attains to the low level, and conduction period of transistor T2 is gradually made shorter. Therefore, charging current decreases and the voltage is stepped up moderately. By such operation, it is possible to keep output voltage V3 constant.

As for a light load which consume less current, the output voltage V3 is higher than the voltage at point b, and the conduction period of the transistor T2 is made the shortest. Therefore, the period until the counter electromotive force of inductance element L1 lowers becomes shorter. At this time, when the charged output voltage V3 flows in the reverse direction through transistor T1 and inductance element L1 to power supply V2, the output voltage V3 may possibly be lowered, resulting in the "discontinuity". Light load detecting circuit 7 is for preventing this discontinuity, and it is adapted to such that the output of comparing circuit 71 is inverted to render transistor T1 non-conductive when the output voltage V3 becomes higher than the voltage at point b, whereby the problem of discontinuity of the current flowing to inductance element L1 can be prevented.

In a state of malfunction in which output terminal OUT is short-circuited to the reference potential, operation similar to the above described charging operation is performed. However, since transistor T1 is not always conductive, undesirable heat build up of the diode for preventing reverse flow caused by continuous flow of short-circuit current from various power supplies to output terminal OUT such as experienced in the prior art is prevented. Therefore, the apparatus can be used without any specific protection circuit. However, it is preferable to provide a timer circuit for stopping operation of driving circuit 6 when the output voltage V3 does not attain to the prescribed voltage even when the stepping operation is continued for a prescribed time period or more, and to provide a protection circuit for preventing conduction of transistor T1 until the timer circuit is reset by an external reset input (not shown).

Meanwhile, when the power supply V1 having a voltage value higher than the output voltage V3 is selected by switch S1 and stepped down to be provided as the output voltage, switch circuit S2 is connected to the output side of constant voltage circuit 4 in accordance with the result of detection by input voltage detecting circuit 9. Therefore, a feedback circuit which controls the base voltage of transistor T1 in accordance with the reference voltage of constant voltage circuit 4 is formed, and input voltage V1 is stepped down by transistor T1 and a constant output voltage V3 is output. At this time, when the circuit is adapted to stop operations of error detecting circuit 5, driving circuit 6 and the like in accordance with the results of detection of input voltage detecting circuit 9, current consumption can be reduced.

When electrical disconnection between output terminal OUT and respective power supplies is desired in the sleep state or the standby state of the portable equipment, such electrical disconnection can be readily realized without substantial addition of any circuitry, simply by controlling switch circuit S2 so that the base voltage of transistor T1 is fixed at a high level.

The present invention is not limited to the above described embodiment. For example, circuit structures of constant voltage circuit 4, error detecting circuit 5 and driving circuit 6 may be different from those shown in FIG. 1 provided that similar operations are performed. The clock signal of driving circuit 6 may be externally supplied, and the base of transistor T1 may be pulled up by means of a resistor. Further, polarities of bipolar transistors may be changed, MOS transistors may be used in place of bipolar transistors, and any type of power supplies may be used. Further, the power supply apparatus of the present invention may be formed by a semiconductor device in which control circuit portion 1 and switch circuit S1 are integrated into one, or the apparatus may be formed as a hybrid integrated circuit using separate electronic components.

As described above, according to the embodiment of the present invention, by complementary switching operation in which transistors T1 and T2 are alternately rendered conductive, the power supply voltage can be stepped up by a simple circuit structure without using a diode for preventing reverse flow, the power loss caused by the diode for preventing reverse flow can be eliminated and efficiency in conversion in voltage can be improved easily.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A power supply apparatus for stepping up a voltage input from a power supply and outputting a constant voltage from an output terminal, comprising:

an inductance element and a first switching element connected in series between said input terminal and said output terminal;

a second switching element connected between a node between said inductance element and said first switching element and a line of a reference potential;

a voltage holding element connected between said output terminal and said line of the reference potential; and control means responsive to the output voltage of said output terminal for alternately rendering conductive said first and second switching elements while charging said voltage holding element, for stepping up the voltage of said power supply, wherein said control means includes input voltage detecting means for detecting whether the voltage of said power supply is not lower than a prescribed voltage, and power supply control means responsive to detection by said input voltage detecting means that the voltage of said power supply is lower than said prescribed voltage, for alternately rendering conductive said first and second switching elements while outputting a stepped up constant voltage, and responsive to detection that the voltage of said power supply is higher than said prescribed voltage, controlling input voltage of said first switching element for outputting a voltage obtained by stepping down the voltage of said power supply.

2. The power supply apparatus according to claim 1, wherein said power supply control means includes constant voltage means for comparing the voltage of said output terminal with a predetermined voltage for controlling the input voltage of said first switching element, light load detecting means comparing the voltage of said output terminal and a voltage at a node between said inductance element and said first switching element, responsive to the voltage of said output terminal being higher than the voltage of said node, for rendering non-conductive said first switching element, and switching means for switching and applying to the input of said first switching element, an output signal from said constant voltage means and an output signal from said light load detecting means, wherein said input voltage detecting means switches said switching means to the side of said constant voltage means in response to the voltage of said power supply being higher than said prescribed voltage, and switches said switching means to the side of said light load detecting means responsive to the voltage of said power supply being not higher than said prescribed voltage.

3. The power supply apparatus according to claim 2, wherein said light load detecting means includes comparing means for comparing the voltage of said output terminal and a voltage at a node between said inductance element and said first switching element, and an OR gate for providing an OR between an output signal from said comparing means and an input voltage to said second switching element, and applying the OR to said switching means.

4. The power supply apparatus according to claim 3, wherein said power supply control means includes driving means for rendering conductive said second switching element at a prescribed duty ratio when the voltage of said output terminal is not higher than a predetermined voltage.

5. The power supply apparatus according to claim 4, wherein said driving means includes first comparing means for comparing the voltage of said output terminal with said predetermined voltage, chopping wave signal generating means for generating a chopping wave signal, and second comparing means for comparing an output signal from said first comparing means and the output signal from said chopping wave generating means, for generating a driving signal of said prescribed duty ratio and applying it to the input of said second switching element.

6. A power supply apparatus for stepping up a voltage input from a power supply and outputting a constant voltage from an output terminal, comprising:

an inductance element and a first switching element connected in series between said input terminal and said output terminal;

a second switching element connected between a node between said inductance element and said first switching element and a line of a reference potential;

a voltage holding element connected between said output terminal and said line of the reference potential; and control means responsive to the output voltage of said output terminal for alternately rendering conductive said first and second switching elements while charging said voltage holding element, for stepping up the voltage of said power supply, wherein said control means includes input voltage detecting means for detecting whether the voltage of said power supply is not lower than a prescribed voltage, and power supply control means responsive to detection by said input voltage detecting means that the voltage of said power supply is lower than said prescribed voltage, for alternately rendering conductive said first and second switching elements while outputting a stepped up constant voltage, and responsive to detection that the voltage of said power supply is higher than said prescribed voltage, controlling input voltage of said first switching element for outputting a voltage obtained by stepping down the voltage of said power supply, wherein said power supply control means includes constant voltage means for comparing the voltage of said output terminal with a predetermined voltage for controlling the input voltage of said first switching element, light load detecting means comparing the voltage of said output terminal and a voltage at a node between said inductance element and said first switching element, responsive to the voltage of said output terminal being higher than the voltage of said node, for rendering non-conductive said first switching element, and switching means for switching and applying to the input of said first switching element, an output signal from said constant voltage means and an output signal from said light load detecting means, wherein said input voltage detecting means switches said switching means to the side of said constant voltage means in response to the voltage of said power supply being higher than said prescribed voltage, and switches said switching means to the side of said light load detecting means responsive to the voltage of said power supply being not higher than said prescribed voltage.

7. The power supply apparatus according to claim 6, wherein said light load detecting means includes comparing means for comparing the voltage of said output terminal and a voltage at a node between said inductance element and said first switching element, and an OR gate for providing an OR between an output signal from said comparing means and an input voltage to said second switching element, and applying the OR to said switching means.

8. The power supply apparatus according to claim 7, wherein said power supply control means includes driving means for rendering conductive said second switching element at a prescribed duty ratio when the voltage of said output terminal is not higher than a predetermined voltage.

9. The power supply apparatus according to claim 8, wherein said driving means includes first comparing means for comparing the voltage of said output terminal with said predetermined voltage, chopping wave signal generating means for generating a chopping wave signal, and second comparing means for comparing an output signal from said first comparing means and the output signal from said chopping wave generating means, for generating a driving signal of said prescribed duty ratio and applying it to the input of said second switching element.

* * * * *